US005806991A

United States Patent [19]

Hübler

[11] Patent Number: 5,806,991

[45] Date of Patent: Sep. 15, 1998

[54] METHOD AND PRINTING APPARATUS FOR PRINTING THE FRONT AND/OR BACK OF INDIVIDUAL SHEETS OF A PRODUCT IN BOOK OR BOOKLET FORM

[76] Inventor: Torsten Hübler, Pohlstrasse 69, Berlin, Germany, 10785

[21] Appl. No.: 727,939

[22] Filed: Oct. 9, 1996

[30] Foreign Application Priority Data

Oct. 10, 1995 [DE] Germany ..... 195 37 742.7

[51] Int. Cl.[6] ..... B41J 3/28

[52] U.S. Cl. ..... 400/24; 61/490; 61/645

[58] Field of Search ..... 400/24, 25, 26, 400/27, 28, 645, 45

[56] References Cited

U.S. PATENT DOCUMENTS

| | | | |
|---|---|---|---|
| 4,488,367 | 12/1984 | Yamauchi et al. | 400/25 |
| 4,516,866 | 5/1985 | Yamauchi et al. . | |
| 4,870,258 | 9/1989 | Mochizuki et al. | 400/25 |
| 5,156,465 | 10/1992 | Kakiuchi | 400/24 |
| 5,183,347 | 2/1993 | Higuchi et al. | 400/25 |
| 5,267,799 | 12/1993 | Nukada | 400/26 |
| 5,286,956 | 2/1994 | Mochizuki | 400/24 |

FOREIGN PATENT DOCUMENTS

| | | |
|---|---|---|
| 0439934 | 3/1995 | European Pat. Off. . |
| 0381137 | 4/1995 | European Pat. Off. . |

OTHER PUBLICATIONS

"Passbook Printing Improvement" IBM Tech. Disc. Bulletin vol. 29 No. 6 pp. 2724–2725 Nov. 1986.

*Primary Examiner*—Eugene H. Eickholt
*Attorney, Agent, or Firm*—Reising, Ethington, Learman & McCulloch, PLLC

[57] ABSTRACT

The invention relates to a method and to a printing machine for printing the front and/or back of individual sheets of a product in book or booklet form which is transported by means of a conveyor arrangement. In this case the sheet to be printed is first of all raised, relative to the remaining portion of the product resting on the conveyor arrangement, so far that the front and/or back of this sheet can be printed.

12 Claims, 3 Drawing Sheets

METHOD AND PRINTING APPARATUS FOR PRINTING THE FRONT AND/OR BACK OF INDIVIDUAL SHEETS OF A PRODUCT IN BOOK OR BOOKLET FORM

The invention relates to a method according to the preamble to claim 1 as well as a printing machine according to the generic concept of claim 6 for printing the front and/or back of individual sheets of a product in book or booklet form.

In U.S. Pat. No. 4,516,866 a method of printing is described in which products in booklet form, for example identity papers or savings books, are moved in the open state on a conveyor track past a print head. With the aid of the print head the inside of the booklet can then be printed on the opened page.

EP-B-0 381 137 further discloses a page-turning arrangement with which the individual pages of the product can be turned over. After the end of the page-turning operation the product is delivered to the printing arrangement for printing of the page which has been turned over.

A printing machine is also known from EP-B-0 439 934 in which a page to be printed is picked up in a specially shaped frictional contact area and is delivered to a printing arrangement. After the printing operation the page is turned over in order, if appropriate, to print a new page. However, this method has the disadvantage that because of the actual motion of the product to be printed it is not possible as a rule for the image for printing to be aligned exactly with the geometry of the booklet. Moreover, adjustment and maintenance of the many moving parts such as guide rollers, frictional contact wheels and flaps are very costly.

The object of the present invention, therefore, is to improve the method according to the preamble to claim 1 as well as the printing machine according to the generic concept of claim 6 so as to reduce the time for printing a product comprising a plurality of sheets.

This object is achieved according to the invention by the characterising features of claim 1.

Further features of the invention are the subject matter of the subordinate claims.

According to the invention a sheet of the product which is to be printed is first of all raised, relative to the remaining portion of the product resting on the conveyor arrangement, so far that the front and/or back of this sheet can then be printed.

In one embodiment of the invention the raised page of the product is turned over further during the printing operation. In a further embodiment it is possible for a new page to be raised already while printing of the preceding page is still being completed.

Figure 2:
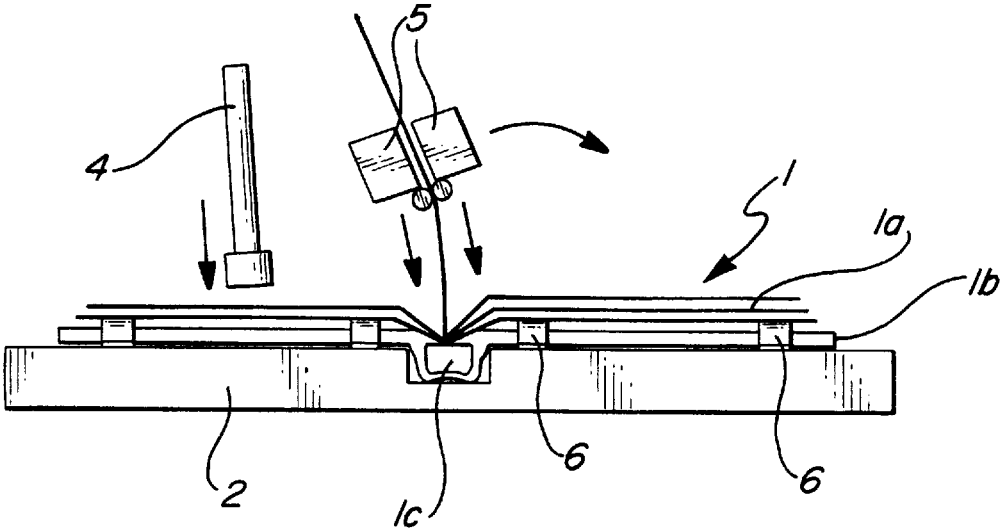
Figure 3A:
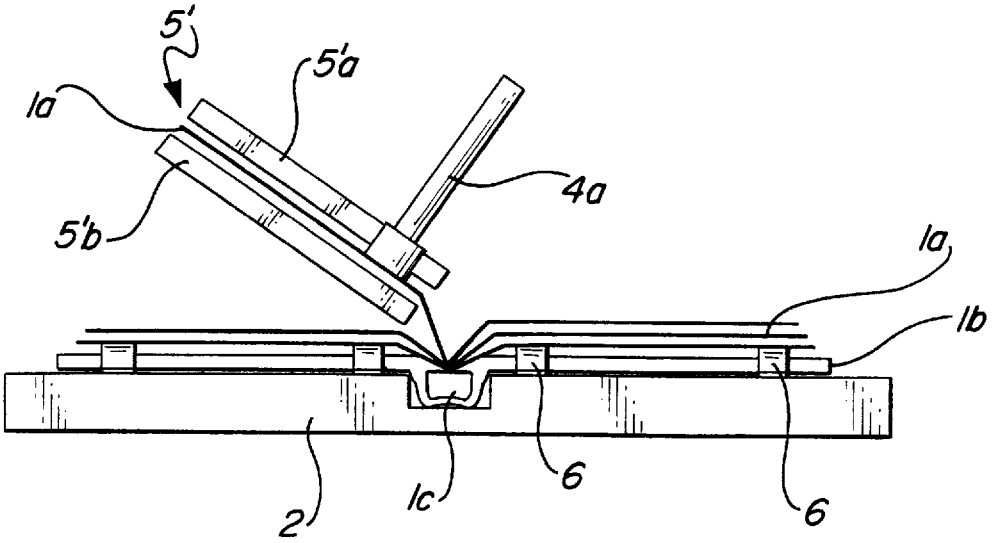
Figure 3B:
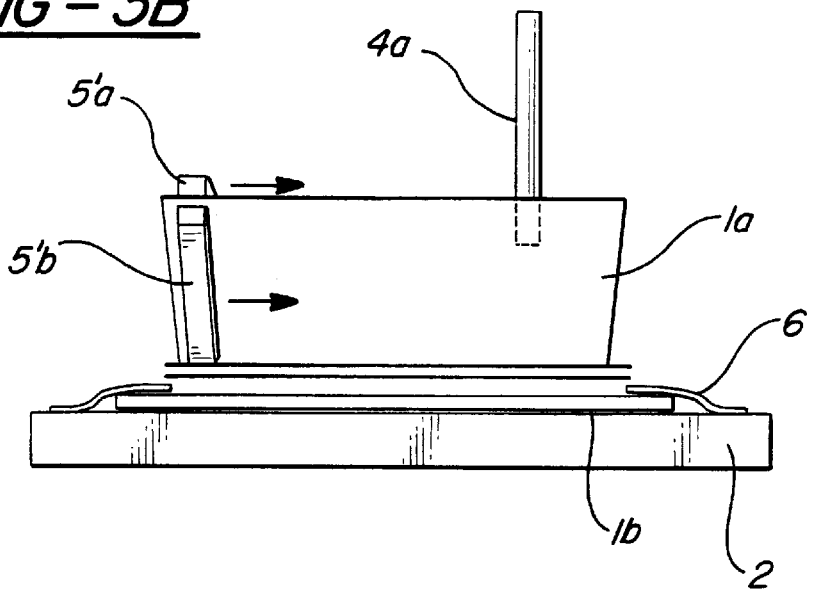

Further advantages and embodiments of the invention are explained in greater detail in the following description of some embodiments and the drawings, in which:

FIGS. 1*a* to 1*d* show a schematic representation of the individual steps of the method of printing according to a first embodiment;

FIG. 2 shows a schematic representation of the printing operation according to a second embodiment and FIGS. 3*a* and 3*b* show a schematic representation of the printing operation according to a third embodiment.

The product 1 in book or booklet form which is to be printed consists essentially of a plurality of sheets 1*a*, an upper and lower book or booklet cover 1*b* as well as a spine 1*c*.

The printing machine which is shown schematically in FIGS. 1*a* to 1*d* in various stages of the printing operation consists essentially of a conveyor arrangement for transporting the product 1, a page-turning arrangement 4 as well as a printing arrangement 5. A holding arrangement 2 is also provided which is moved with the conveyor arrangement and is fixed relative to the product 1 at least during the printing operation. For this purpose fixing means 6 which come into contact with the product 1 are provided on the holding arrangement and are constructed for example as spring clamping elements.

The holding arrangement 2 is further distinguished by a flat supporting surface 2*a* for the upper and lower book or booklet cover 1*b* of the product 1 as well as a recess 2*b* to receive the spine 1*c*. Thus in the open state of the product the upper and lower book covers come to lie in a plane on the supporting surface 2*a*, whilst the spine 1*c* which curves outwards protrudes into the recess 2*b*. Within the scope of the invention, however, the two areas of the supporting surface can enclose an angle with respect to one another to the right and left of the recess, so that the product 1 is disposed with an aperture angle>180° on the holding arrangement 2.

The alignment of the product 1 on the holding arrangement 2 can be achieved for example by suitable stops which in some circumstances are combined with the fixing means 6. In addition to clamping elements, to all other conceivable securing means, such as for example a suction arrangement, may be considered as fixing means 6.

The holding arrangement 2 is connected to the conveyor arrangement by way of suitable guide means, for example guide tracks or rails, in order to ensure exact guiding of the product 1 through the printing machine.

The printing operation according to a first embodiment is set out below with reference to FIGS. 1*a* to 1*d:*

The page-turning arrangement 4 represented in this embodiment consists of a first means for raising a sheet 1*a* to be printed relative to the remaining portion of the product 1 resting on the conveyor arrangement of the holding arrangement 2. The sheet 1*a* is raised for example into a substantially perpendicular position. The first means are formed for example by suction elements which produce a firm contact with the sheet 1*a* and then raise the sheet 1*a* by a rotary movement. A defined position of the raised sheet can be ensured by an optionally flat construction or multi-point contacts. In the illustrated embodiment the first means is shown in simplified form by a suction pipe 4*a*.

Figure 1A:
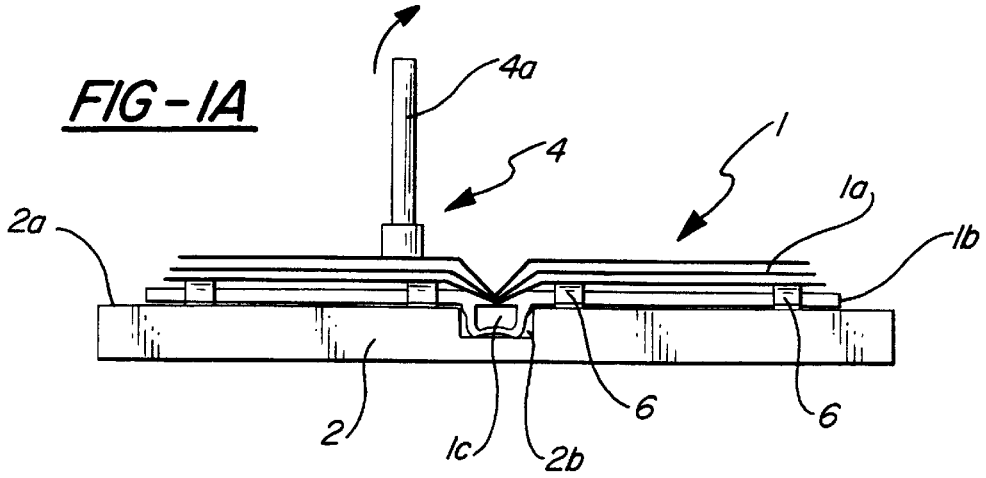
Figure 1B:
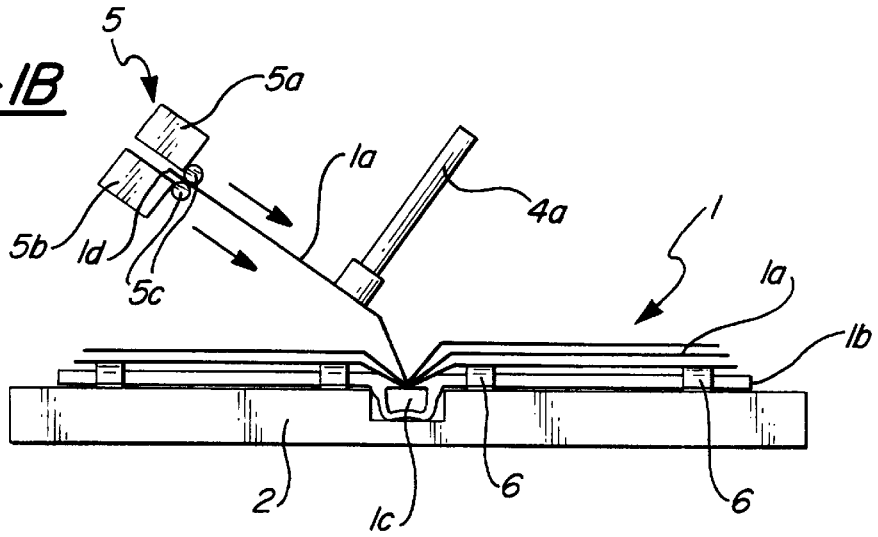

In a first step the sheet 1*a* is raised by the suction pipe 4*a* so far that the printing arrangement 5 can attach onto the outer edge 1*d* of the sheet, as can be seen from FIG. 1*b*. The printing arrangement 5 has an upper and lower printing unit 5*a*, 5*b* which facilitate simultaneous printing of the front and back of the sheet 1*a*. Furthermore a line extending over the entire height of the sheet 1*a* is printed simultaneously.

During the printing operation the printing arrangement 5 is moved relative to the sheet 1*a* from the outer edge 1*d* thereof to the spine 1*c* of the book or booklet.

The printing arrangement 5 also has distance pieces 5*c*, e.g. in the form of pressure rollers, with which a defined distance from the printing arrangement to the sheet 1*a* is ensured.

As soon as the printing arrangement 5 has gripped the sheet 1*a* to be printed or during the printing operation the suction pipe 4*a* is released from the sheet 1*a* and is pivoted away. As soon as the printing arrangement has completely printed the front and/or back of the sheet 1*a* it is also pivoted away from the sheet 1*a*.

Figure 1C:
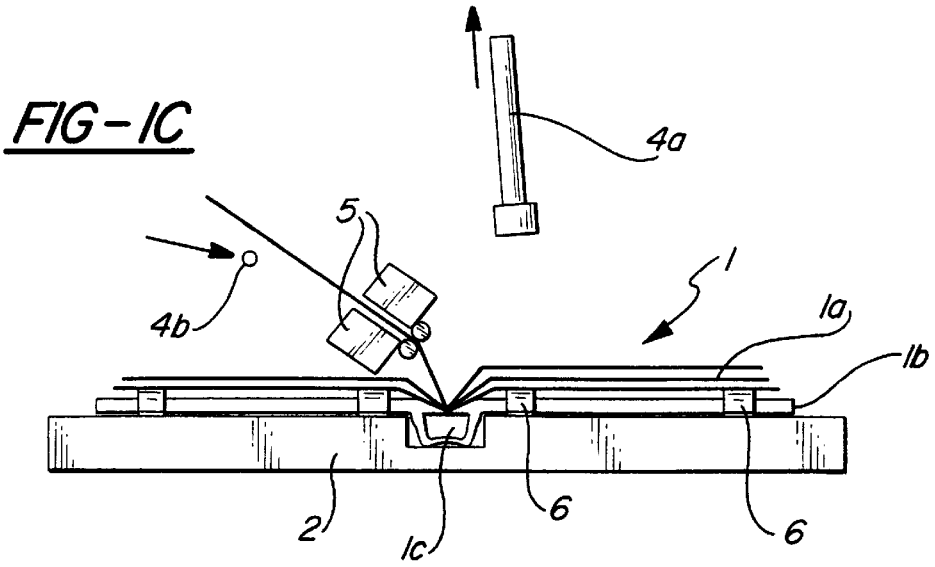
Figure 1D:
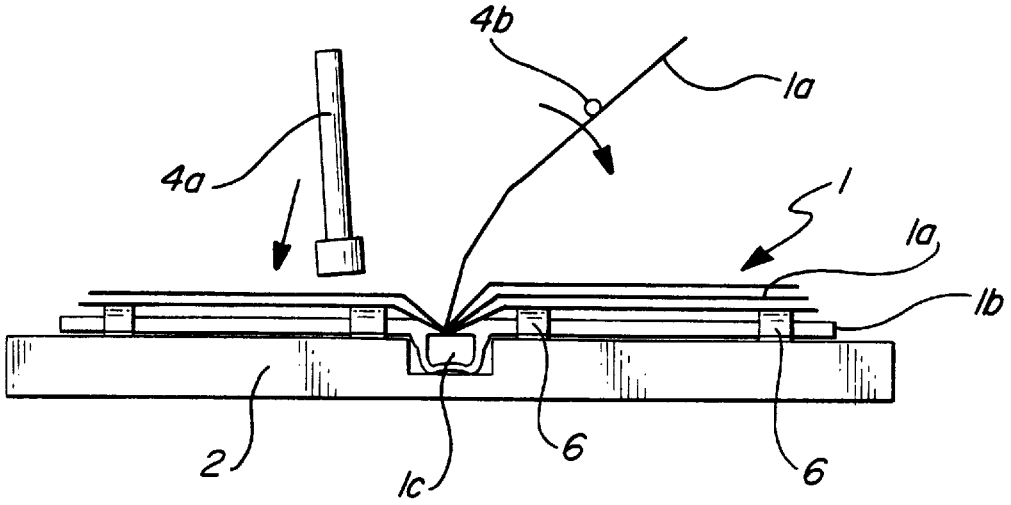

In the present embodiment the page-turning operation is then continued by a guide roller 4*b*, cf. FIGS. 1*c* and 1*d*.

Before the sheet 1*a* which has just been printed is turned over completely the suction pipe 4*a* can already raise a new sheet.

FIG. 2 shows a variant of the first embodiment in which the printing arrangement 5 itself completes the page-turning operation. For this purpose the printing arrangement must not only be relatively movable from the outer edge of the sheet to the spine, but it must also be pivotably disposed relative to the product 1. In this case the pivoting arrangement can either take place by a movement of the printing arrangement, of the holding arrangement or by a combined movement of both arrangements.

In FIGS. 3*a* and 3*b* a further embodiment is shown which only differs in the direction of printing. Whereas in the first two embodiments the direction of printing is at right angles to the spine 1*c* of the book or booklet, the direction of printing in the embodiment according to FIGS. 3*a* and 3*b* is in line with the spine 1*c*. In this embodiment the printing arrangement 5' can be formed by an upper and lower printing unit 5'*a*, 5'*b* which each print a line parallel over the entire width of the sheet 1*a*.

In all embodiments the printing arrangement 5' is designed for digital printing processes. It also includes all necessary equipment, such as fixing or drying and transfer arrangements. In the case of multi-colour printing the movement of the printing arrangement must if appropriate be repeated sequentially.

In order for the image for printing to be adapted exactly to the geometry of the book or booklet, the position of the product with respect to the printing arrangement must be determined exactly. In the simplest case the product can be aligned by corresponding stops on the holding arrangement. However, it would also be conceivable to combine suitable sensor arrangements with the printing arrangement in order for example to determine the position of the outer edge or the upper printing edge at the start of the printing operation.

The construction of the printing arrangement for simultaneous printing of the front and back of a sheet 1*a* shortens the time for printing the entire product. Furthermore, if the printing operation and the page-turning operation are carried out so that they overlap chronologically the times can be shortened even further.

I claim:

1. Method of printing the front and/or back of individual sheets (1*a*) of a product (1) in book or booklet form which is transported by means of a conveyor arrangement, characterised in that a sheet (1*a*) which is to be printed is first of all raised, relative to the remaining portion of the product (1) resting on the conveyor arrangement, so far that the front and/or back of this sheet can then be printed.

2. Method as claimed in claim 1, characterised in that the product has a book or booklet spine (1*c*) and the printing takes place at right angles to this spine.

3. Method as claimed in claim 1, characterised in that the product has a book or booklet spine (1*c*) and the printing takes place in line with the spine.

4. Method as claimed in claim 1, characterised in that the page-turning operation for one sheet (1*a*) takes place at least partially during the printing of this sheet.

5. Method as claimed in claim 1, characterised in that before the end of the page-turning operation for one sheet (1*a*) the following sheet is already raised for printing.

6. Printing machine for printing the front and/or back of individual sheets (1*a*) of a product (1) in book or booklet form, comprising a) a conveyor arrangement for transporting the product (1) through the printing machine, b) a page-turning arrangement (4), c) as well as a printing arrangement (5; 5'), characterised in that d) the page-turning arrangement has first means for raising a sheet (1*a*) to be printed relative to the remaining portion of the product (1) resting on the conveyor arrangement, e) and that the printing arrangement (5; 5') is disposed so as to be movable relative to the raised sheet (1*a*) in such a way that the front and/or back of this sheet can be printed.

7. Printing machine as claimed in claim 6, characterised in that the first means of the page-turning arrangement (4) are formed by at least one suction pipe (4*a*).

8. Printing machine as claimed in claim 7, characterised in that the page-turning arrangement (4) also has a guide roller (4*b*).

9. Printing machine as claimed in claim 6, characterised in that the printing arrangement (5; 5') is constructed for parallel printing of a line which runs over the entire height or width of the sheet (1*a*) to be printed.

10. Printing machine as claimed in claim 6, characterised in that the printing arrangement (5; 5') is constructed for simultaneous printing of the front and back of the sheet (1*a*).

11. Printing machine as claimed in claim 6, characterised in that there is also provided a holding arrangement (2) which is moved with the conveyor arrangement and is fixed relative to the product (1) at least during the printing operation.

12. Printing machine as claimed in claim 11, characterised in that the holding arrangement (2) has a supporting surface (2*a*) for the opened product (1) as well as a recess (2*b*) in the supporting surface to receive the book or booklet spine (1*c*) of the product.

* * * * *